US005505572A

United States Patent [19]

Fujimori

[11] Patent Number: 5,505,572

[45] Date of Patent: Apr. 9, 1996

[54] SEALED CONTAINER AND METHOD OF MANUFACTURING SAME

[75] Inventor: Hikoichiro Fujimori, deceased, late of Osaka, Japan, by Hideko Fujimori, legal representative

[73] Assignee: Nippon Kayaku Kabushiki Kaisha, Tokyo, Japan

[21] Appl. No.: 390,238

[22] Filed: Feb. 17, 1995

Related U.S. Application Data

[63] Continuation of Ser. No. 949,622, filed as PCT/JP92/00453, Apr. 10, 1992, abandoned.

[30] Foreign Application Priority Data

Apr. 12, 1991 [JP] Japan ..... 3-108431
Jun. 3, 1991 [JP] Japan ..... 3-050218 U

[51] Int. Cl.[6] ..... B21D 51/32

[52] U.S. Cl. ..... 413/6; 413/31; 53/334; 53/340; 53/366

[58] Field of Search ..... 413/4, 5, 6, 7, 413/31, 27; 53/334, 340, 349, 354, 366; 220/506, 612, 906, 23.83, 23.86, 566, DIG. 13, 617, 309, 310

[56] References Cited

U.S. PATENT DOCUMENTS

| | | | |
|---|---|---|---|
| 132,595 | 10/1872 | Norton | 413/31 |
| 1,227,830 | 5/1917 | Richards . | |
| 2,178,683 | 11/1939 | Frischman et al. | 263/48 |
| 2,725,000 | 11/1955 | O'Neill | 93/36.5 |
| 3,540,394 | 11/1970 | Ignell | 113/80 |
| 3,953,957 | 5/1976 | Brothers | 53/329 |
| 4,561,675 | 12/1985 | Adams et al. | 280/734 |
| 4,574,607 | 3/1986 | Akino et al. | 72/112 |
| 4,762,224 | 8/1988 | Hall | 206/221 |
| 4,858,951 | 8/1989 | Lenzen | 280/741 |
| 4,905,859 | 3/1990 | Jonker | 220/67 |

FOREIGN PATENT DOCUMENTS

| | | |
|---|---|---|
| 49-52078 | 5/1974 | Japan . |
| 53-157043 | 12/1978 | Japan . |
| 54-80440 | 6/1979 | Japan . |
| 58-41632 | 3/1983 | Japan . |
| 61-170534 | 10/1986 | Japan . |
| 984491 | 3/1963 | United Kingdom . |

*Primary Examiner*—Jack W. Lavinder
*Attorney, Agent, or Firm*—Nields & Lemack

[57] ABSTRACT

A sealed container in which a container body having a ring-like shape and a hollow portion at the center includes opening portions on which a cap member of a similar ring-like shape is attached. The container body is sealed when the annular groove portions of a cap member clamp inner and outer edges of opening portions of the ring-like shaped container body and are secured on inner and outer peripheral surfaces of each of these edges. The can member therefore can be easily attached on the container body so that sealing operation can be effected smoothly and mass-production can be achieved. Also disclosed is a method of manufacturing such a container.

5 Claims, 7 Drawing Sheets

SEALED CONTAINER AND METHOD OF MANUFACTURING SAME

This application is a continuation of application Ser. No. 07/949,622 filed as PCT/JP92/00453, Apr. 10, 1992 now abandoned.

TECHNICAL FIELD

The present invention relates to a sealed container in which a container body of a ring-like shape having a hollow portion at the center includes opening portions on which a cap member of a similar ring-like shape for sealing the container body is attached, and a manufacturing method of it and, more particularly, to a sealed container with a container body which contains a material and is sealed at opening portions such that it has an excellent sealing effectiveness and can be mass-produced, and a manufacturing method of it.

BACKGROUND ART

As a container of this kind, for example, there has conventionally been known a container of a ring-like shape which contains explosive powder for inflating an air bag for safety of a driver and passengers of a vehicle. Such a container includes upright flange portions formed on opening portions of a container body, and these upright flange portions and edge portions of a cap member are integrally rolled and tightened, so that explosive powder or pellets (a gas generating agent) will be stored in the container body in an airtight condition. An example of this container is shown in FIG. 10. In FIG. 10, reference numeral 50 denotes a container body of a sealed container having a ring-like shape, and a hollow portion 51 is formed in the center of the container body 50. A cap member 52 having a ring-like shape of substantially the same diameter is fitted in upright flange portions 50*a* of the container body 50, and edge portions 52*a* of the cap member 52 and the upright flange portions 50*a* are integrally rolled and tightened inside of the container body 50.

However, this container involves the following drawbacks.

(1) When the outer diameter of the container body 50 is small (for example, when the container has a diameter of 60 mm or less), it is extremely troublesome to roll and tighten the container body 50 and the cap member 52 integrally in the sealing step of the container body 50. Therefore, mass-production of such containers is difficult.

(2) Since it is particularly troublesome to roll and tighten the opening portions of the container having a ring-like shape and the cap member having a similar shape so as to seal up the container, mass-production of such containers is difficult.

This invention has been achieved in consideration of these conventional problems, and it is a first object of the invention to provide a sealed container whose container body can be sealed up by attaching a cap member to the container body easily and which is suitable for mass-production.

Further, it is a second object of the invention to provide a manufacturing method of a sealed container, in which sealing operation of a container body by attaching a cap member to it is facilitated, and especially in the case of a small-diameter container or a container of a ring-like shape, sealing operation of a container body by attaching a cap member to it is facilitated, and the method is suitable for mass-production.

More specifically, a sealed container according to the invention, in which a container body of a ring-like shape having a hollow portion at the center includes opening portions on which a cap member of a similar ring-like shape for sealing the container body is attached, is characterized in that annular groove portions are formed in those portions of the cap member which are to be matched to the opening portions of the container body, an outer edge of each of the annular groove portions is tightenedly connected to an outer peripheral surface of each of the opening portions, and an inner edge of the annular groove portion is tightenedly connected to an inner peripheral surface of the opening portion, so that the cap member clamps and is secured on the opening portions of the container body. Therefore, the annular groove portions of the cap member are engaged with the associated opening portions of the container body, and then, the outer edges of the annular groove portions are tightenedly connected to the outer peripheral surfaces of the opening portions forcibly, whereas their inner edges are tightenedly connected to the inner peripheral surfaces of the opening portions forcibly. In consequence, the cap member securely clamps and is fixed on the opening portions of the container body at the annular groove portions.

Moreover, a manufacturing method of a sealed container according to the invention is characterized in that a container body with an opening portion is fixed on a container holding table, the opening portion of the container body is inserted between an inner edge and an outer edge of an annular flange formed on the outer periphery of a cap member, the cap member is secured on the container body by a holder die from the upper side, the container body is rotated, and a roll is contacted with said outer edge and pressed thereon to tightenedly connect the outer edge to an outer wall of the opening portion while the inner edge is tightenedly connected to an inner wall of the opening portion by the holder die, so that the cap member clamps and is secured on the container body. Consequently, the container body is fixed on the container holding table, and also, the holder die is contacted with the top surface of the cap member, so that the container is securely fixed from the upper and lower sides. At this time, since a wedge of the holder die is fitted in the annular flange formed on the outer periphery of the cap member, there is no fear that the cap member will be attached on the opening portion of the container body in a displaced condition. Further, by contacting the rotatable roll with the outer edge of the annular flange, the outer edge is strongly tightenedly connected to the outer wall of the opening portion of the container body, and also, the inner edge of the annular flange is strongly tightenedly connected to the inner wall of the opening portion of the container body by means of the outer peripheral surface of the wedge of the holder die. Thus, the annular flange of the cap member securely clamps and is fixed on the opening portion of the container body.

BEST MODE FOR CARRYING OUT THE INVENTION

The present invention will be hereinafter described with reference to the attached drawings.

Figure 1:
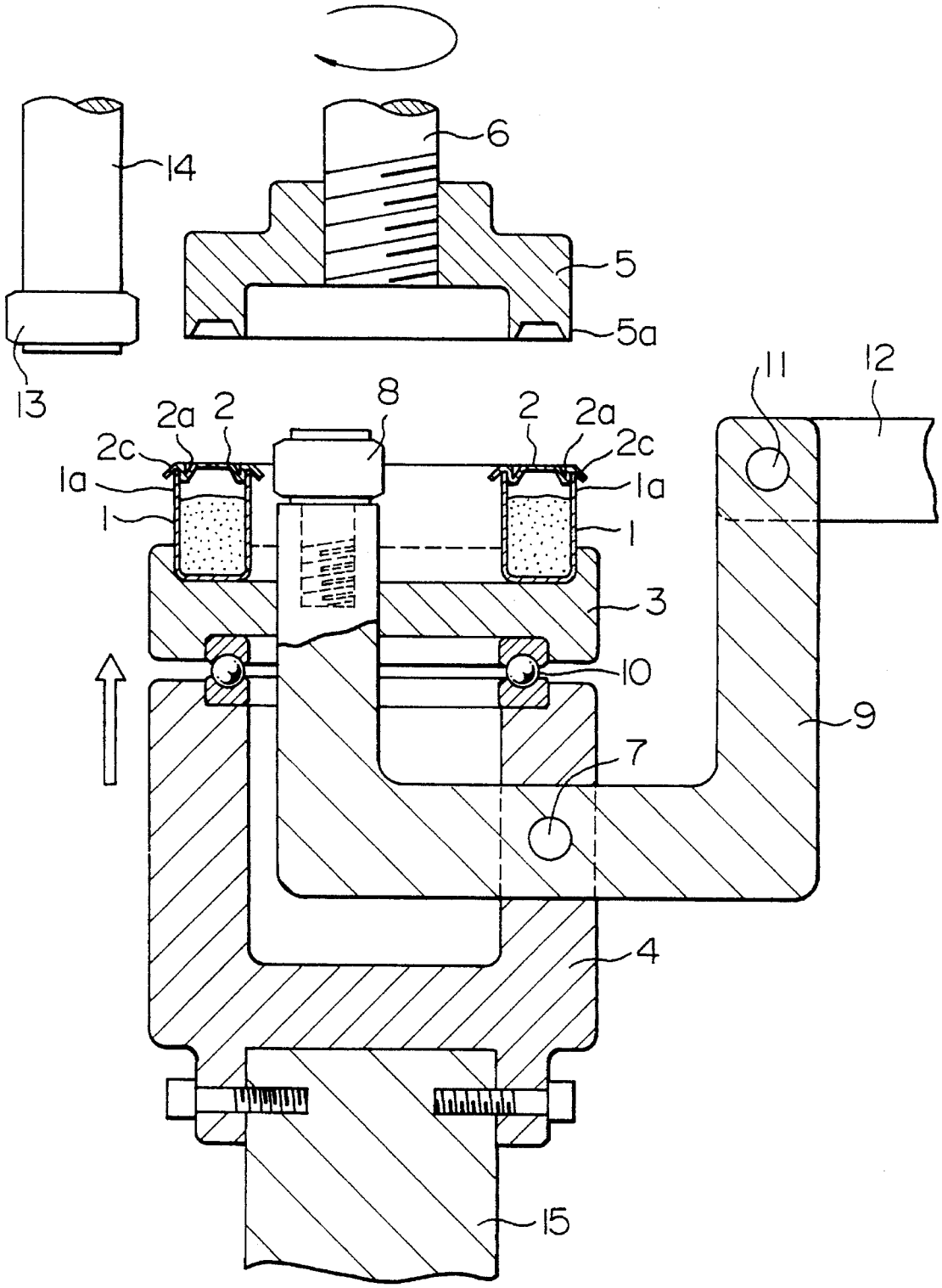
FIG. 1 is a cross-sectional view showing a manufacturing step and a manufacturing apparatus at a preparation stage for attaching a cap member on a container body in a manufacturing method according to the present invention.
Figure 2:
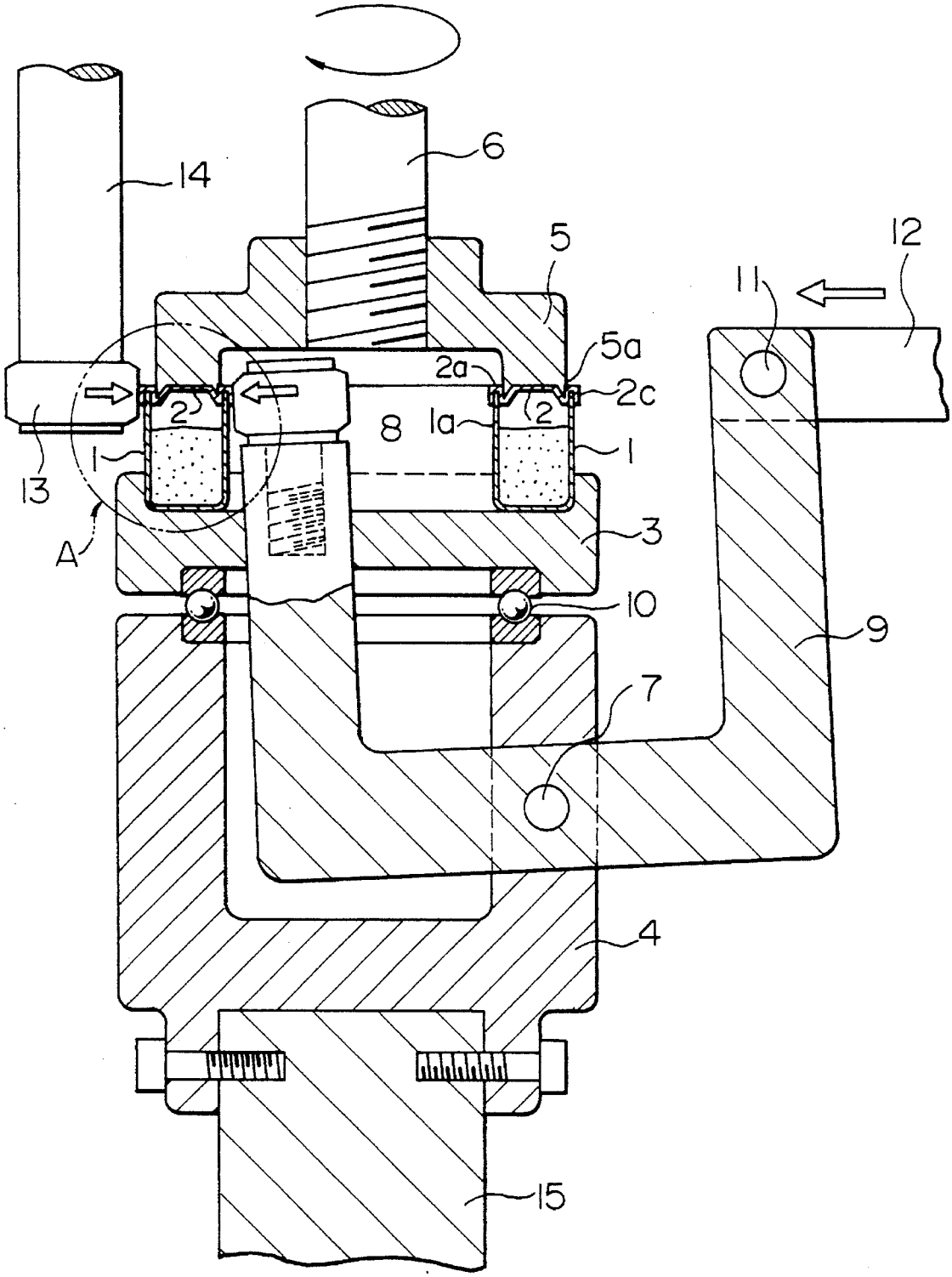
FIG. 2 is a cross-sectional view showing a manufacturing step and a manufacturing apparatus in a condition where the container body is sealed with the cap member in the manufacturing method according to the invention.
Figure 4:
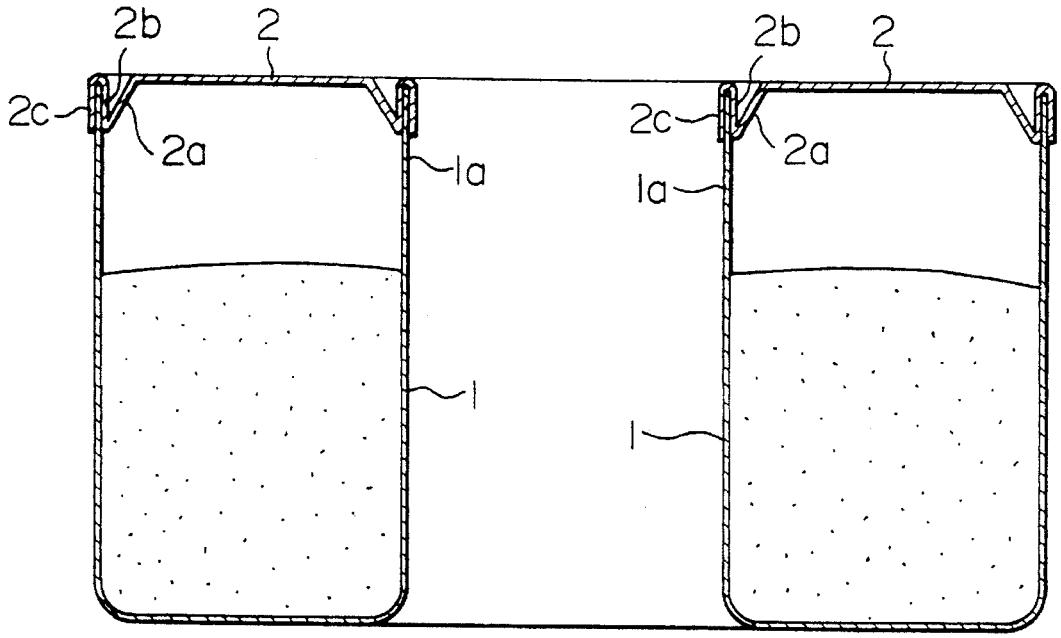
FIG. 4 is a cross-sectional view showing the container body of a ring-like shape manufactured by the manufacturing method according to the invention.

A method for manufacturing a container of a ring-like shape shown in FIG. 4 will be first described as one embodiment. FIG. 1 illustrates a condition in which a container holding table 3 and a raising lowering member 4 are located at the lower positions. A container body 1 and a cap member 2 are mounted on the predetermined positions of the container holding table 3. More specifically, the container body 1 is fixed on the container holding table 3, and the cap member 2 is mounted on opening portions 1*a* of the container body 1. Next, as shown in FIG. 2, the container holding table 3 and the raising lowering member 4 are moved upwardly until a holder die 5 is brought into contact with the top surface of the cap member 2. The holder die 5 is contacted more reliably when wedges 5*a* are closely fitted in the peripheries of annular flanges 2*a* of the cap member 2.

Subsequently, a main shaft 6 connected to a power source is rotated, and the holder die 5 is rotated with the main shaft 6. Then, the container body 1 and the container holding table 3 are rotated synchronously. Since the container holding table 3 is rotatably provided on the raising lowering member 4 through bearings 10, the container holding table 3 is rotated with the container body 1 irrespective of the raising lowering member 4.

Figure 3:
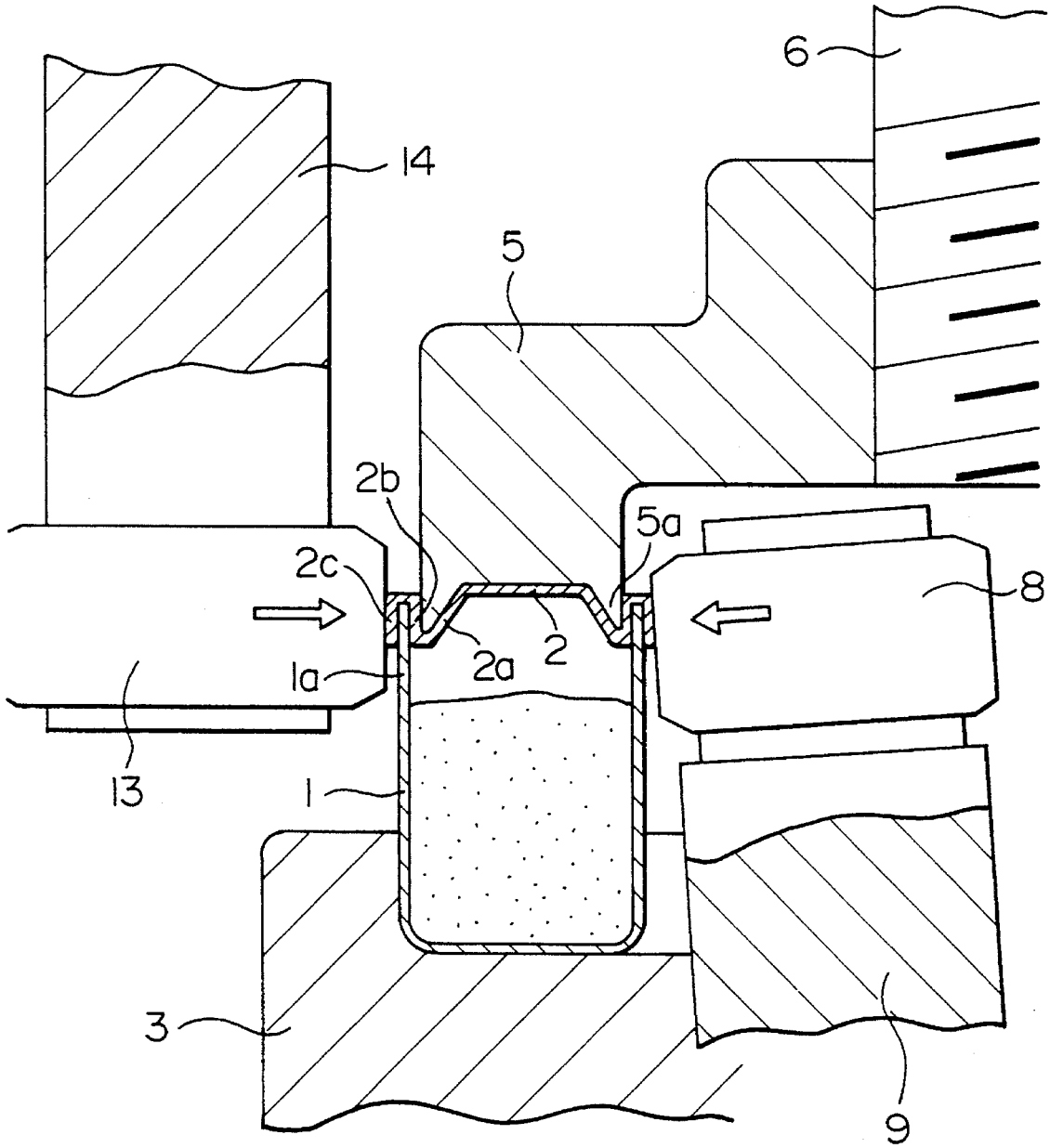
FIG. 3 is an enlarged cross-sectional view of a portion A of FIG. 2 in the manufacturing method according to the invention.

Further, an outer roll 13 pivotally provided on a shaft 14 is brought into contact with an outer edge 2*c* from the outer peripheral side so as to tightenedly connect the outer edge 2*c* on an outer wall of the opening portion 1*a*. A U-shaped roll carrier arm 9 is attached on the raising lowering member 4 and pivotally supported thereon by a shaft 7. An inner roll 8 is pivotally provided on one end of the roll carrier arm 9, and the inner roll 8 is brought into contact with an outer edge 2*c* from the inner peripheral side so as to tightenedly connect the outer edge 2*c* on an inner wall of the opening portion 1*a*. The wedges 5*a* of the holder die 5 fitted in the annular flanges 2*a* of the cap member 2 serve to sustain pressing forces from the inner roll 8 and the outer roll 13. The annular flanges 2*a* are formed by forming a pair of annular grooves in the lower surface of the cap member 2 and a recessed portion in the upper surface of the cap member 2. The annular grooves receive the opening portion the ring shaped container body. The recessed portion receives the holder die. The depth of the recessed portion is substantially equal to the depth of the annular grooves. As shown in FIG. 3, the periphery of each wedge 5*a* presses an inner edge 2*b* of the annular flange 2*a*, and the inner edge 2*b* is tightenedly connected on the inner wall of the opening portion 1*a*. The outer roll 13 can be brought into contact with the outer edge 2*c* by moving the shaft 14 toward the container body 1. Also, as shown in FIG. 2, the inner roll 8 can be brought into contact with the outer edge 2*c* by moving a connecting link 12, which is pivotally supported on the other end of the roll carrier arm 9 through a shaft 11, toward the container body 1 (in a direction indicated by the arrow) automatically or manually, and inclining the roll carrier arm 9 about the shaft 7.

In a different embodiment for manufacturing a container of an ordinary cylindrical shape, the cylindrical container can be sealed by rotating it about a center shaft, contacting an outer edge 2*c* with an opening portion 1*a*, and pressing it thereon by use of at least one of the outer roll 13 and the inner roll 8.

In order to improve the sealing effectiveness, an adhesive (e.g., an epoxy-base adhesive) is applied to the inner surfaces of the annular flanges 2*a* and (or) the opening portions 1*a* of the container body 1. Thus, the sealing effectiveness of the cap member 2 with respect to the container body 1 can be further enhanced.

An apparatus used in the manufacturing method according to the invention will now be described. The main shaft 6 connected to the power source is provided on an upper portion of the apparatus, and the holder die 5 is screw-fastened on the main shaft 6. The wedges 5*a* fitted in the annular flanges 2*a* of the cap member 2 are formed on the lower end of the holder die 5. The outer roll 13 pivotally attached on the shaft 14 which can be moved in parallel is provided at the side of the holder die 5 so that the outer edge 2*c* can be tightenedly connected on the outer wall of the opening portion 1*a* similarly.

The container holding table 3 for fixing the cap member 2 and the container body 1 is provided under the holder die 5, and the container holding table 3 is rotatably provided on the raising lowering member 4 through the bearings 10. The container holding table 3 and the raising lowering member 4 are supported on a mount 15 and freely raised/lowered. The outer roll 13 can be contacted with or separated from the outer edge 2*c* by moving the shaft 14 horizontally. Also, the U-shaped roll carrier member 9 is pivotally supported on the raising lowering member 4 through the shaft 7. The inner roll 8 is pivotally attached on one end of the roll carrier member 9, and the connecting link 12 is pivotally supported on the other end of it through the shaft 11. The roll carrier member 9 is displaced about the shaft 7 by moving the connecting link 12 horizontally so that the inner roll 8 can be contacted with or separated from the outer edge 2*c* of the cap member 2.

According to the invention, as described so far, the container body is sealed when the cap member clamps the opening portions of the container body and is secured thereon, to thereby remarkably facilitate the operation of attaching the cap member on the container body. Therefore, by the manufacturing method of the invention, mass-production of container bodies can be realized.

Next, sealed containers according to the invention which are manufactured by the above-described method will be described on the basis of embodiments shown in FIGS. 5 to 9. It has been understood that when an adhesive or a lining material is applied to the inner surfaces of annular groove portions 25 and (or) opening portions 23 of a container body 22, a clamping securing force of a cap member 24 with respect to the container body 22 is further strengthened, and also, the sealing effectiveness is improved. As the adhesive, a polyester-base adhesive, a nylon-base adhesive, a double-fluid adhesive, a rubber-base coating material or the like can be employed.

Figure 5:
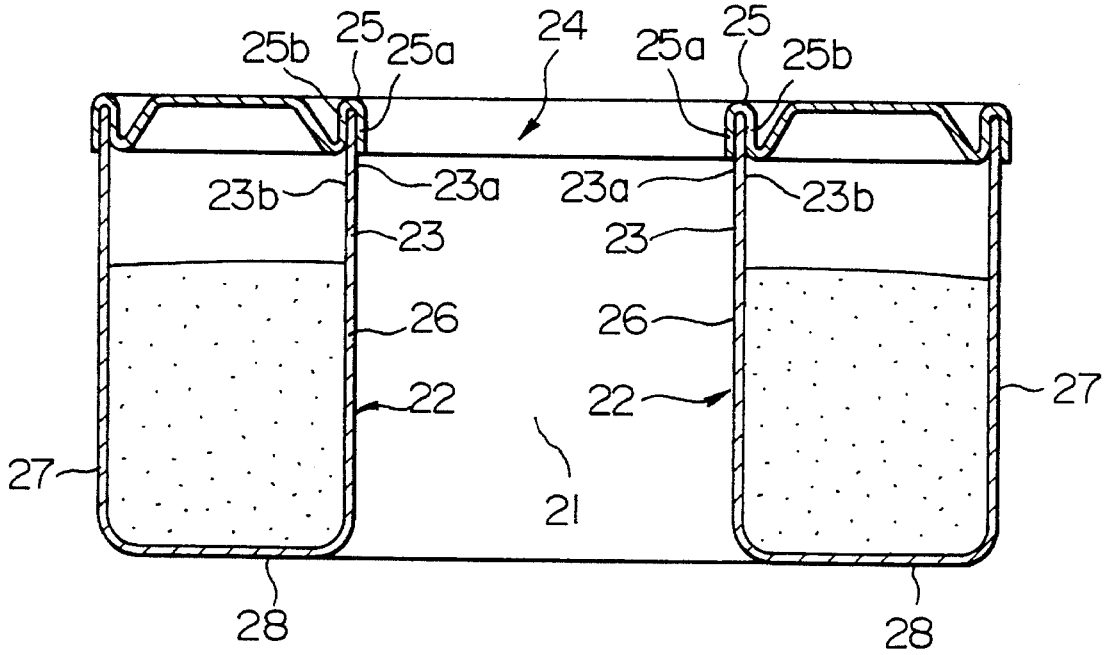
FIG. 5 is a front cross-sectional view showing another embodiment of a sealed container according to the invention.
Figure 6:
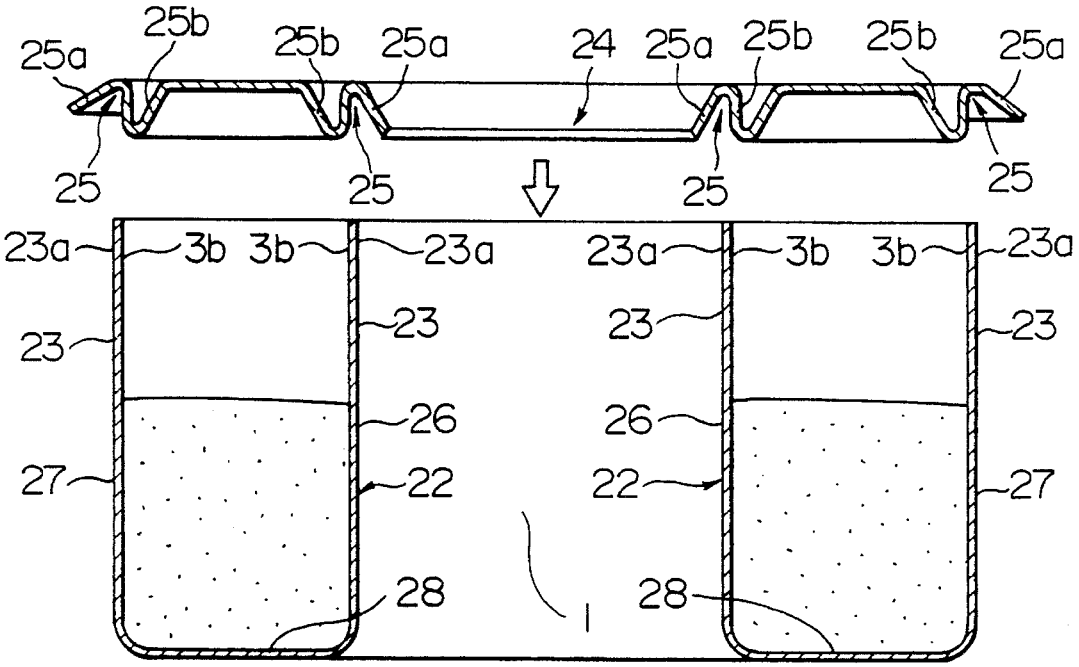
FIG. 6 is a front cross-sectional view of the sealed container according to the invention shown in FIG. 5, in a condition where it is divided into a cap member and a container body.
Figure 7:
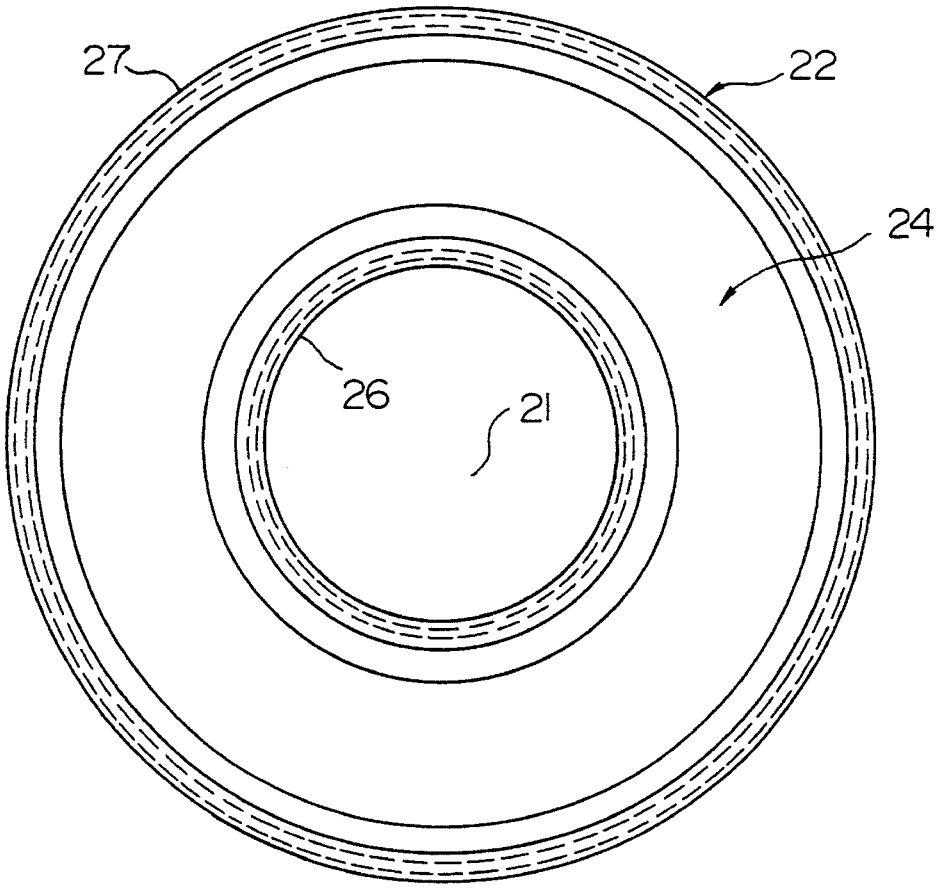
FIG. 7 is a plan view of the sealed container according to the invention shown in FIG. 5.
Figure 8:
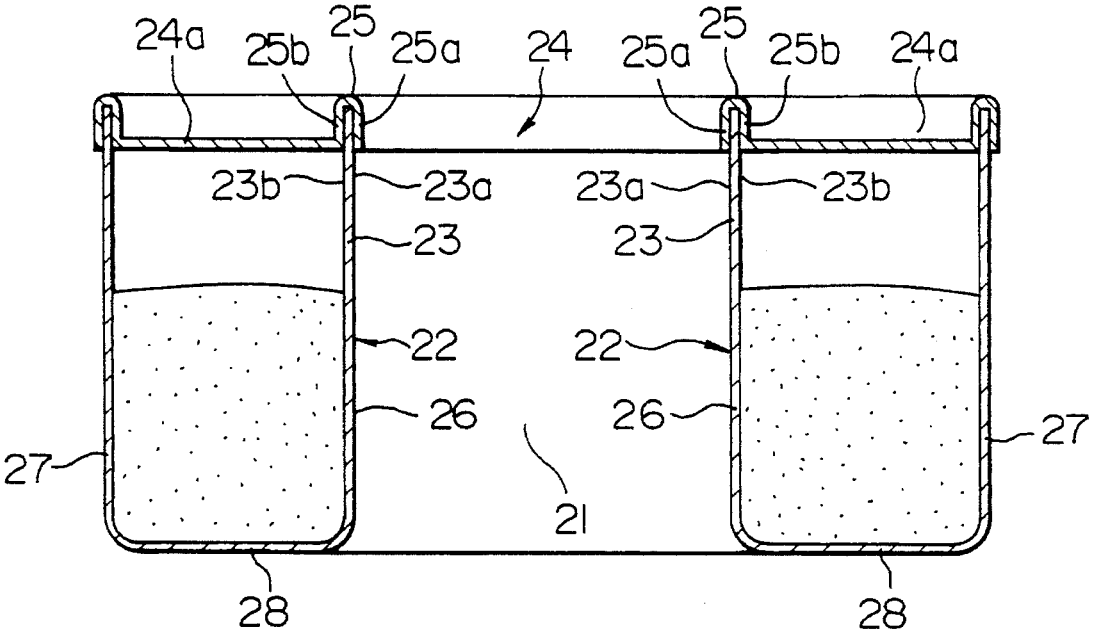
FIG. 8 is a front cross-sectional view showing a still other embodiment of a sealed container according to the invention.

In the sealed containers of the invention shown in FIGS. 5, 6 and 8, an inner wall 26, an outer wall 27 and a bottom wall 28 of the container body 22 are all formed to have a uniform thickness. The wall thickness can be determined at a desirable value within a range of, for example, 0.1 to 0.3 mm.

A sealed container shown in FIG. 8 is one embodiment in which a sealing portion 24*a* of a cap member 24 is formed to extend horizontally. The function of the sealed container itself does not vary in accordance with the shape of the sealing portion 24*a* of the cap member 24. The shape of the sealing portion 24*a* can be determined, as desired, corresponding to the distal configuration of a die for securely fixing the cap member 24 on a container body 22 in the manufacturing step.

Figure 9:
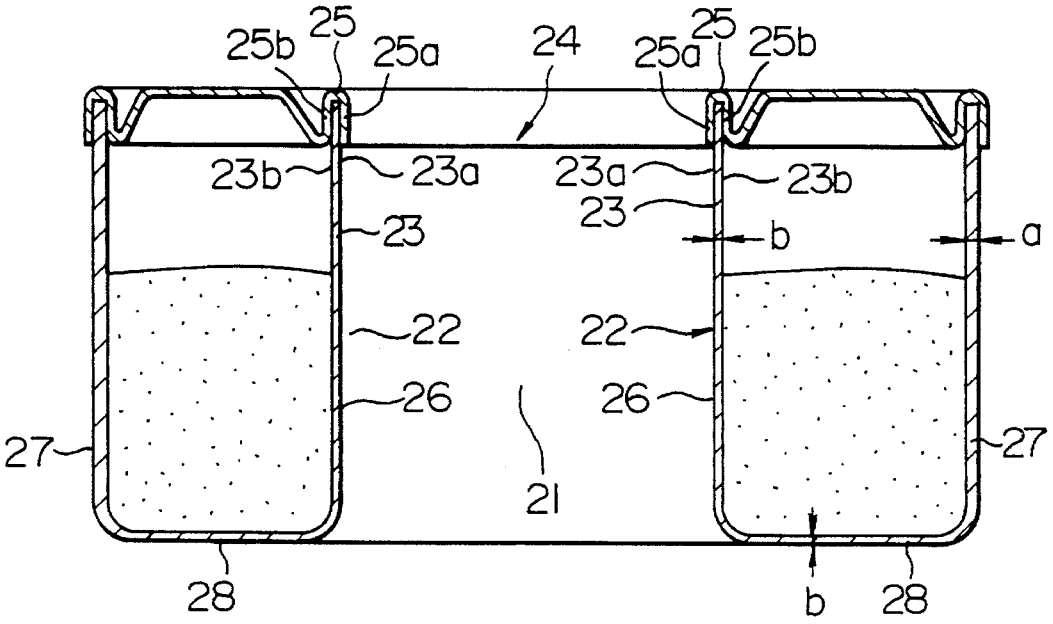
FIG. 9 is a front cross-sectional view showing a modified embodiment of a sealed container according to the invention.
Figure 10:
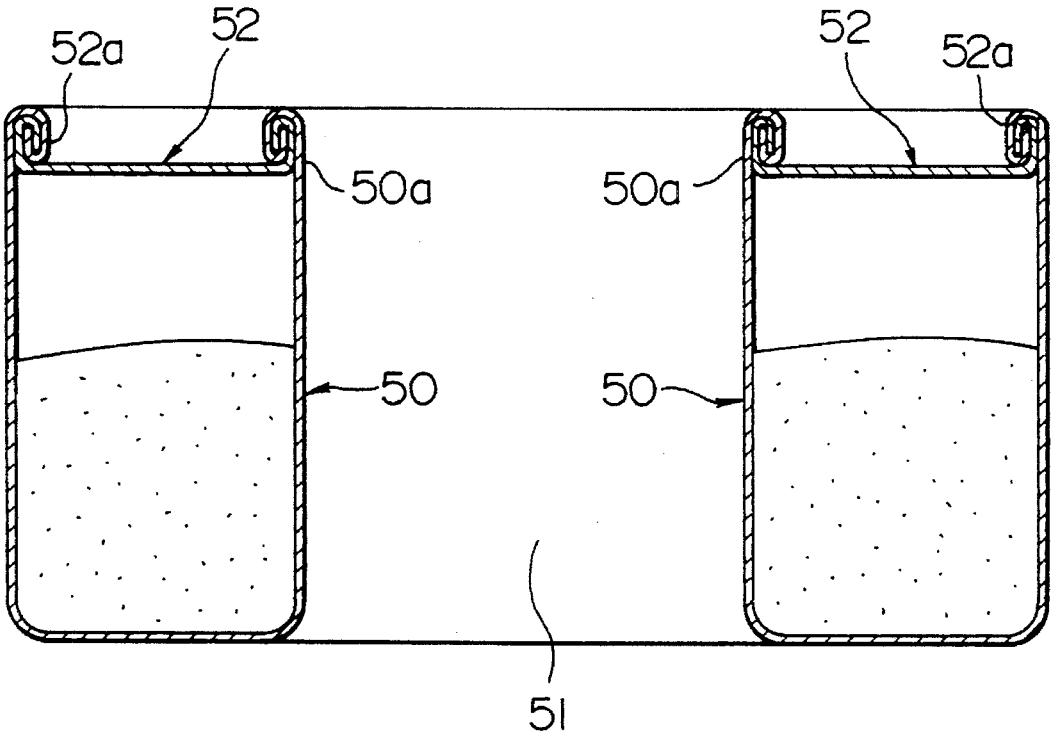
FIG. 10 is a front cross-sectional view showing a conventional example of a sealed container in which a cap member is attached on a container body by rolling and tightening.

FIG. 9 is a front cross-sectional view of one embodiment in which, of an inner wall 26, an outer wall 27 and a bottom wall 28 of a container body 22, the inner wall 26 and the bottom wall 28 are subjected to drawing with ironing and formed to be thinner than the outer wall 27. For example, a=0.2 mm, b=0.15 mm, a> b can be settled. In order to inspect the sealing function of this embodiment, a container of a=0.15 mm was sealed (by use of an acryl-base adhesive), and then, an air pressure of 0.5 MPa was applied to it as an inner pressure. However, leakage and breakage were not induced. Also, in a leakage test of a differential pressure type, a container sealed in the same manner exhibited a leakage amount of 10–4 cc/sec or less, and the container was not changed after a durability test. In the durability test (100 repetitions of exposure to 120° C. to −40° C.), the probability of sealing breakage was ⅕ or more. A container sealed in a method shown in FIG. 10 exhibits a leakage order of 10–3 cc/sec or more so that a large amount of adhesive must be used for decreasing the leakage amount of the initial function. In the embodiment shown in FIG. 9, the inner wall 26 and the outer wall 27 are different in thickness for the following reason. In the case where powder such as explosive or pellets (e.g., a gas generating agent composed of sodium azide and potassium nitrate) are stored in the container body 22 as a component part of an air bag system which is a safety device for an automobile, the inner wall 26 and the bottom wall 28 are broken more quickly than the outer wall 27 so that a generated high-pressure nitrogen gas can be delivered in a desired direction. Then, the high-pressure nitrogen gas efficiently inflates an air bag installed inside of a steering wheel of an automobile, which air bag can effectively protect a human body at the time of collision of the automobile. Needless to say, the container according to the invention not only serves as a component part of the air bag system for an automobile but also can contain various other materials. Further, portions subjected to drawing with ironing can be selected from the inner wall 26, the outer wall 27 and the bottom wall 28 as desired, and a rate of decrease in plate thickness owing to drawing with ironing can be set at a desirable value within a range of 8% to 40%.

INDUSTRIAL APPLICABILITY

As described heretofore, the container according to the present invention can be sealed by attaching the cap member on the opening portions of the container body easily. Especially, sealing operation of small-diameter containers of ring-like shapes can be effected quite smoothly, and mass-production of such containers can be performed. Consequently, the container of the invention can be used effectively as a component part of the air bag system which is a safety device for an automobile, a doughnut-shaped container article or a container of a similar shape of various other kinds.

What is claimed is:

1. A method of manufacturing a sealed container, comprising the steps of providing a container having a ring shape container body and an inner and an outer wall; providing a cap member for said container, forming an inner and an outer annular groove in the lower surface of said cap member for sealing said inner and outer walls of said container body such that said inner and outer walls will be inserted in said inner and outer annular grooves, said inner and outer annular grooves each having an outside section and an inner surface; forming a recessed portion of a depth substantially equal to a depth of said annular grooves in the upper surface of said cap member such that a holder die for the cap member can be inserted in the recessed portion; inserting said inner and outer walls in said inner and outer annular grooves; inserting said holder die in said recessed portion of said cap member; rotating said holder die; pressing inner and outer rolls on outside sections of said annular grooves from both sides of said holder die, so as to tightly connect said inner and outer walls of said container body to said annular grooves of said cap member, thus sealing said container body with said cap member.

2. A method of manufacturing a sealed container according to claim 1, further comprising applying an adhesive to said inner surface of said annular grooves of said cap member that engages and seals said inner and outer walls of said container body.

3. A method of manufacturing a sealed container according to claim 2, further comprising applying an adhesive to said inner and outer walls of said container body.

4. A method of manufacturing a sealed container according to claim 1, further comprising mounting said container body on a rotatable container holding table, rotating said cap member and said container body by rotating said holder die, locating said inner and outer rolls on both sides of said holder die, and pressing said inner and outer rolls against said outside sections of said annular grooves.

5. A method of manufacturing a sealed container according to claim 1, further comprising applying an adhesive to said inner and outer walls of said container body.

* * * * *